US010004362B2

(12) United States Patent
Yang

(10) Patent No.: US 10,004,362 B2
(45) Date of Patent: Jun. 26, 2018

(54) STORAGE CONTAINER

(71) Applicant: Kyung su Yang, Seoul (KR)

(72) Inventor: Kyung su Yang, Seoul (KR)

( * ) Notice: Subject to any disclaimer, the term of this patent is extended or adjusted under 35 U.S.C. 154(b) by 0 days. days.

(21) Appl. No.: 15/031,695

(22) PCT Filed: Oct. 16, 2014

(86) PCT No.: PCT/KR2014/009743

§ 371 (c)(1),
(2) Date: Apr. 22, 2016

(87) PCT Pub. No.: WO2015/060579

PCT Pub. Date: Apr. 30, 2015

(65) Prior Publication Data

US 2016/0264307 A1 Sep. 15, 2016

(30) Foreign Application Priority Data

Oct. 23, 2013 (KR) ..... 10-2013-0126570
Jul. 11, 2014 (KR) ..... 10-2014-0087547

(51) Int. Cl.
*B65D 43/14* (2006.01)
*A47K 1/09* (2006.01)

(52) U.S. Cl.
CPC ..... *A47K 1/09* (2013.01)

(58) Field of Classification Search
CPC ..... A47K 1/09; A47K 1/08; B65D 5/0085; B65D 5/009; B65D 43/16; B65D 43/161; B65D 35/22

(Continued)

(56) References Cited

U.S. PATENT DOCUMENTS 9,265,698 B2 * 2/2016 Huxford ..... A47K 1/09
2007/0114891 A1 * 5/2007 Kim ..... A46B 17/04 312/207

(Continued)

FOREIGN PATENT DOCUMENTS

CN 201230853 Y 5/2009
KR 20-0286615 Y1 8/2002

(Continued)

OTHER PUBLICATIONS

International Search Report dated Feb. 12, 2015 of PCT/KR2014/009743 which is the parent application and its English translation—5 pages.

*Primary Examiner* — Kareen Thomas
(74) *Attorney, Agent, or Firm* — Knobbe Martens Olson & Bear LLP

(57) ABSTRACT

A storage container includes a cover portion, a body portion disposed below the cover portion so as to form a storage space together with the cover portion for storing an end of an article therein, and a connecting portion connecting the cover portion and the body portion to each other and imparting a tensile force in an opening direction when the cover portion is moved in an opening direction with respect to the body portion and a tensile force in a closing direction when the cover portion is moved in a closing direction with respect to the body portion. The storage container can be provided in which a cover portion and a body portion are included, and a connecting portion is included inside the storage container to impart tensile force in connection with the cover portion. Thus, storing and withdrawing articles can be done conveniently.

6 Claims, 10 Drawing Sheets

(58) Field of Classification Search
USPC ..... 206/349, 363, 368, 63.5; 220/4.21, 4.22, 220/4.23, 531, 244, 810, 836, 845, 847, 220/848, 735, 736; 312/207
See application file for complete search history.

(56) References Cited

U.S. PATENT DOCUMENTS

| | | | | |
|---|---|---|---|---|
| 2008/0179323 | A1* | 7/2008 | Circosta | A45D 44/18 220/8 |
| 2010/0230312 | A1* | 9/2010 | Sorrentino | B65D 21/0202 206/369 |
| 2014/0252925 | A1* | 9/2014 | Tooma | A46B 17/00 312/207 |

FOREIGN PATENT DOCUMENTS

| | | | |
|---|---|---|---|
| KR | 20-0405861 | Y1 | 1/2006 |
| KR | 20-0431400 | Y1 | 11/2006 |
| KR | 20-0436353 | Y1 | 7/2007 |
| KR | 10-0917311 | B1 | 9/2009 |

* cited by examiner

STORAGE CONTAINER

TECHNICAL FIELD

The present invention relates to a storage container and, more particularly, to a storage container in which a cover part and a body part are provided and a connection part is provided inside the storage container to impart an elastic force in connection with the cover part, thereby facilitating receipt of an article easily.

BACKGROUND ART

There are many kinds of storage containers capable of storing various types of articles such as toothbrushes after using. For example, in the case of toothbrush holders, there are two types, i.e. a family type holder storing multiple toothbrushes and a personal type holder storing only one's toothbrush.

FIG. 8 shows an exemplary one of conventional personal type toothbrush holders. That is, as shown in FIG. 8, a conventional personal type toothbrush holder includes a casing 210 having a shape such as animals or flowers to accommodate a toothbrush. Such a conventional toothbrush holder includes the casing 210 having a storage space therein with an opening 211 formed on one end side thereof such that a toothbrush handle passes through the opening, and a cover part 212 integrally formed on one side of the casing 210 in such a manner as to be able to be opened and closed. However, such a conventional toothbrush holder has a drawback that the cover part 212 should be opened and closed manually.

That is, such a storage container as a conventional toothbrush holder has problems of inconvenient use and insanitary environment, because opening and closing of the cover part 212 should be done with user's manual manipulation. Therefore, researches and developments are required for a new storage container in which a cover part can be simply opened and closed without user's direct manual manipulation, thereby contributing to convenient use.

Related Art Document: Korean Utility Registration Model No. 20-0436353

DISCLOSURE

Technical Problem

An object of the present invention is to provide a storage container in which a cover part and a body part are provided and a connecting part is provided inside the storage container to impart an elastic force in connection with the cover part, thereby facilitating receipt of an article easily.

Technical Solution

In order to achieve the above object, according to one aspect, the present invention provides a storage container including: a cover part; a body part disposed below the cover part so as to form a storage space together with the cover part for storing an end of an article therein; and a connection part connecting the cover part and the body part to each other and respectively imparting an elastic force in an opening direction or a closing direction of the cover part during opening or closing of the cover part with respect to the body part.

The connection part may include: a rotary member rotating at an angle within a predetermined value during relative movement of the cover part with respect to the body part; and a elastic members bent from one end of the rotary member so as to provide an elastic force during the relative movement of the cover part with respect to the body part.

The elastic members may have a pair of coupling holes and the body part may have a pair of coupling protrusions respectively inserted into the pair of coupling holes such that during rotating motion of the rotary member, the connection part is able to be pivoted about the body part.

The elastic members may have a pair of engaging protrusions disposed above the coupling holes and the cover part may have a pair of engaging holes into which the pair of engaging protrusions are respectively inserted such that during opening of the cover part with respect to the body part, the connection part is able to provide an elastic force in the opening direction of the cover part.

The body part may have a pair of rotary protrusions and the cover part may have a pair of rotary holes into which the pair of rotary protrusions are respectively inserted such that during closing of the cover part with respect to the body part, the connection part is able to provide an elastic force in the closing direction of the cover part.

The body part may further have a pair of auxiliary protrusions respectively disposed in proximity to the rotary protrusions and the cover part may further have first and second auxiliary holes respectively formed substantially perpendicular to each other so as to communicate with the rotary holes such that in an opened state of the cover part, one of the auxiliary protrusions is inserted into the first auxiliary hole, and in a closed state of the cover part, the other auxiliary protrusion is inserted into the second auxiliary hole.

The coupling protrusion may have a circular cross-sectional shape and the coupling hole may have a vertically elongated cylindrical cross-sectional shape such that during opening of the cover part, an interactive force between the coupling protrusion and the coupling holes is reduced within a predetermined range.

The storage container may further include an attachment part attaching the body part to an installation surface, and the body part may have an insertion hole and the attachment part may have an insertion protrusion inserted into the insertion hole such that the attachment part is able to be inserted and coupled into the body part.

The body part may be provided, on one side thereof, with an insertion slit into which one end of an article is inserted during storage of the article.

Advantageous Effects

According to the present invention, the storage container can be provided in which the cover part and the body part are provided, and the connecting part is provided inside the storage container to impart an elastic force in connection with the cover part, thereby facilitating convenient receipt of an article easily.

Figure 1:
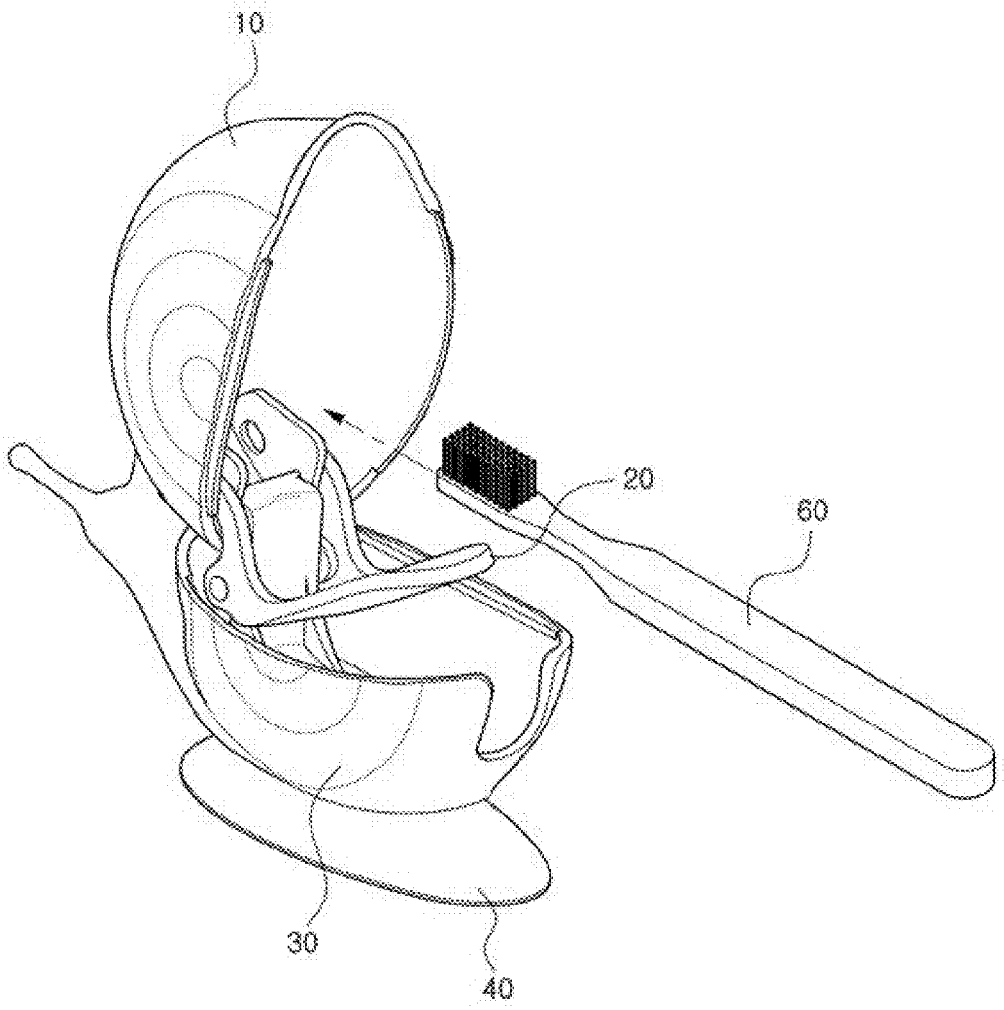
FIG. 1 is a perspective view of a storage container according to an embodiment of the present invention.

<Description of the Reference Numerals in the Drawings>

| | |
|---|---|
| 10, 110: cover part | 12, 112: cover bracket |
| 14, 114: coupling hole | 16, 116: rotary hole |
| 19: support | 20, 120: rotary member |
| 22, 136: engaging hole | 24, 124: coupling protrusion |
| 26, 126: elastic member | 30, 130: body part |
| 32: insertion part | 33, 133: insertion hole |
| 34, 134: body bracket | 36, 122: engaging protrusion |
| 38, 138: rotary protrusion | 39: auxiliary protrusion |
| 40, 140: attachment part | |
| 42, 142: insertion protrusion | |
| 100: storage container | |

MODE FOR INVENTION

Hereinafter, exemplary embodiments of the present invention will be described in detail with reference to the accompanying drawings. In the following description, it is to be noted that a description of already known functions and configurations will be omitted in order to make the gist of the present invention clear.

Although the present invention will now be described with reference to an example of storing a toothbrush, the present invention is not limited to the example, but may include other examples of storing razors, forks, spoons, knives, kitchen utensils, or the like. Further, the storage container of the present invention may be formed of a variety kinds of materials including plastic.

Figure 2:
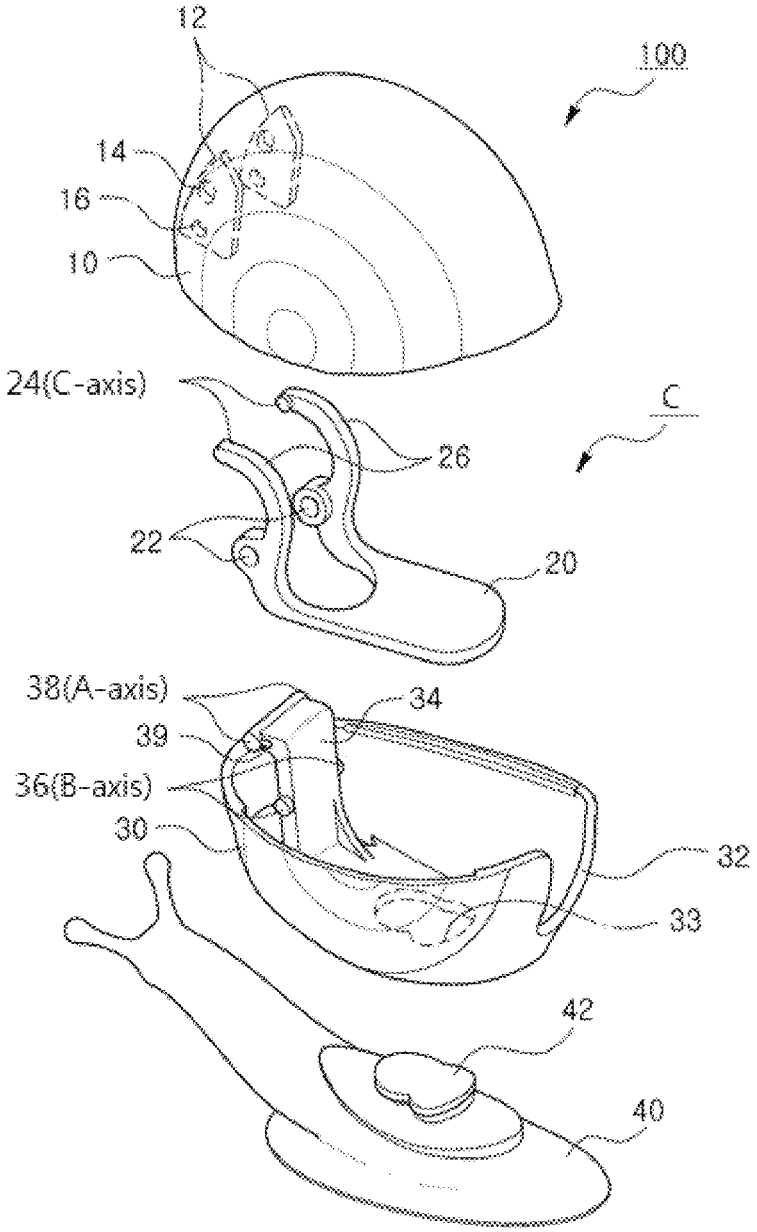
FIG. 2 is an exploded perspective view of the storage container of FIG. 1.
Figure 3:
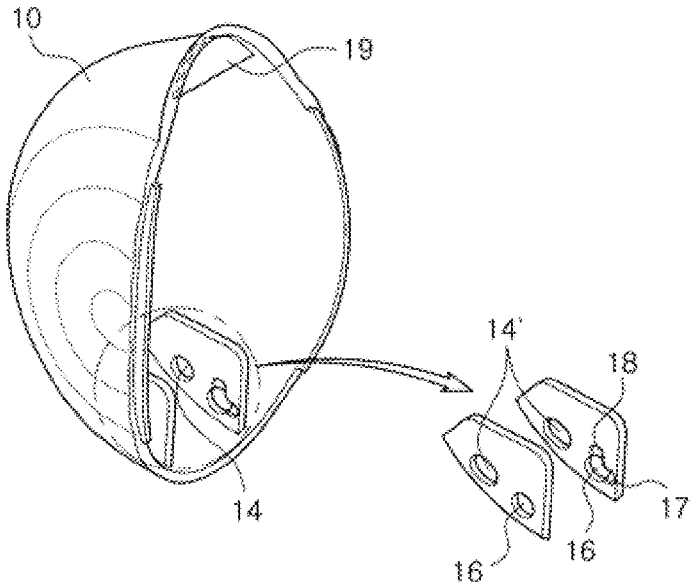
FIG. 3 is a perspective view illustrating an internal space of a cover part of the storage container of FIG. 1.
Figure 4A:
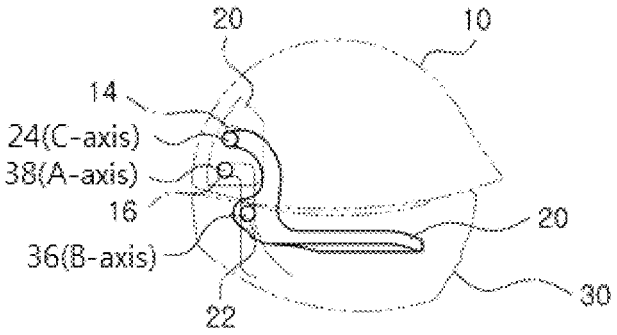
FIG. 4A to FIG. 4C are views illustrating operation of a connection part in the storage container of FIG. 1.
Figure 4B:
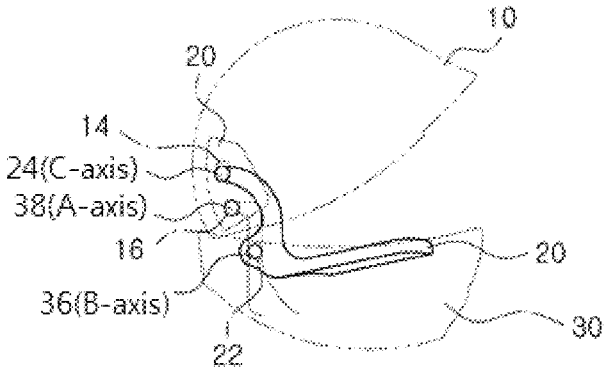
Figure 4C:
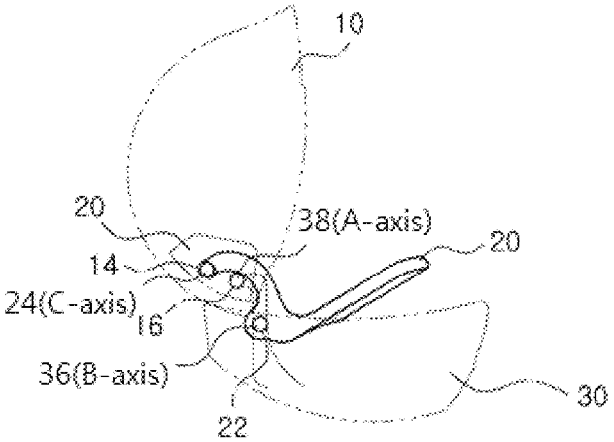
Figure 5A:
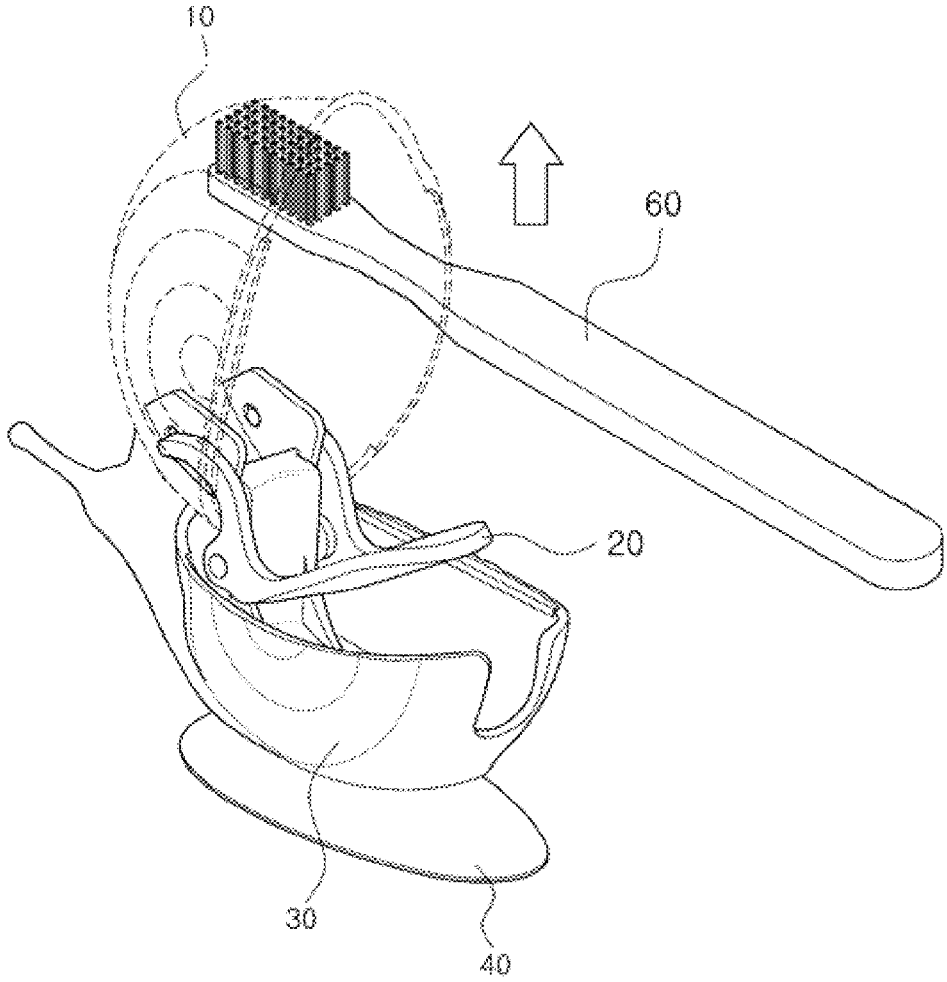
FIG. 5A to FIG. 5C are views illustrating the use of the storage container of FIG. 1.
Figure 5B:
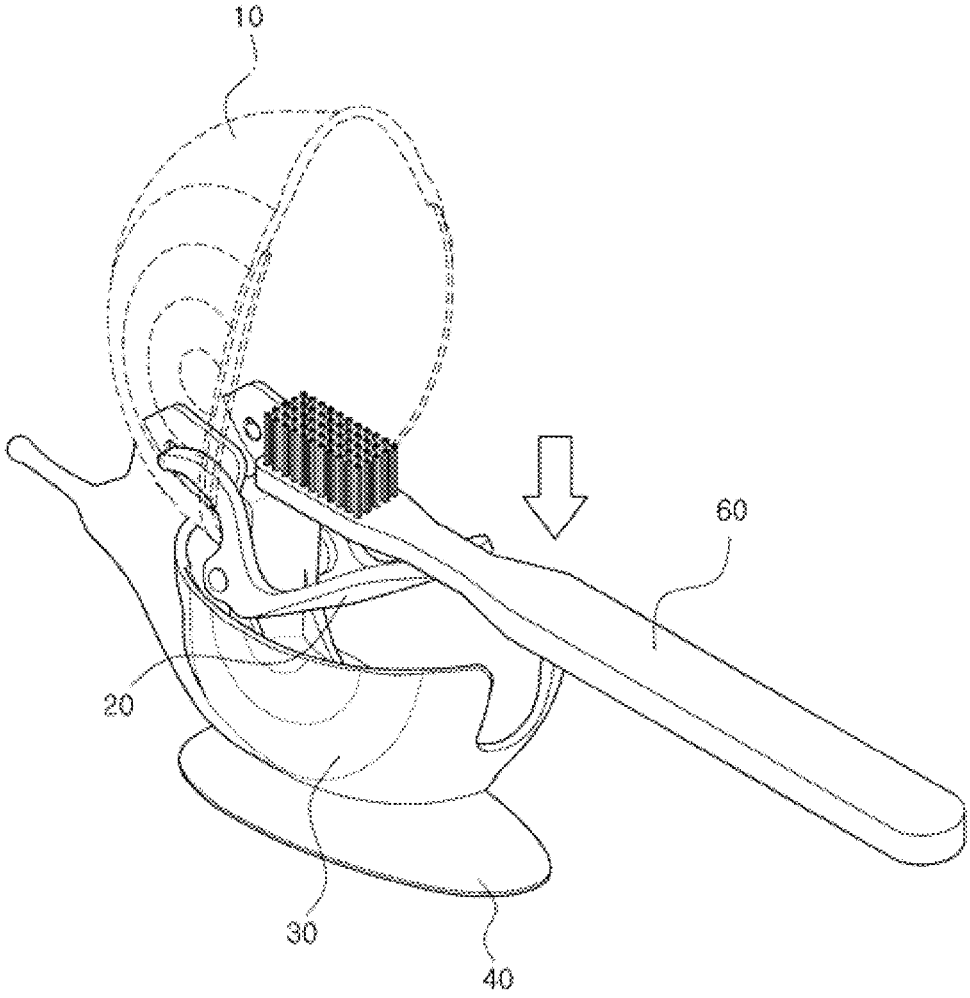
Figure 5C:
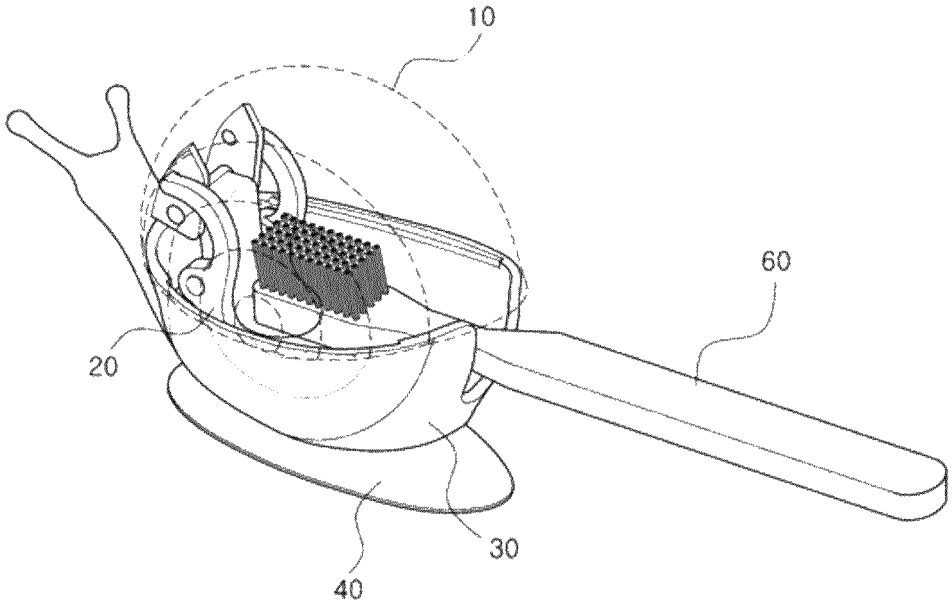
Figure 6:
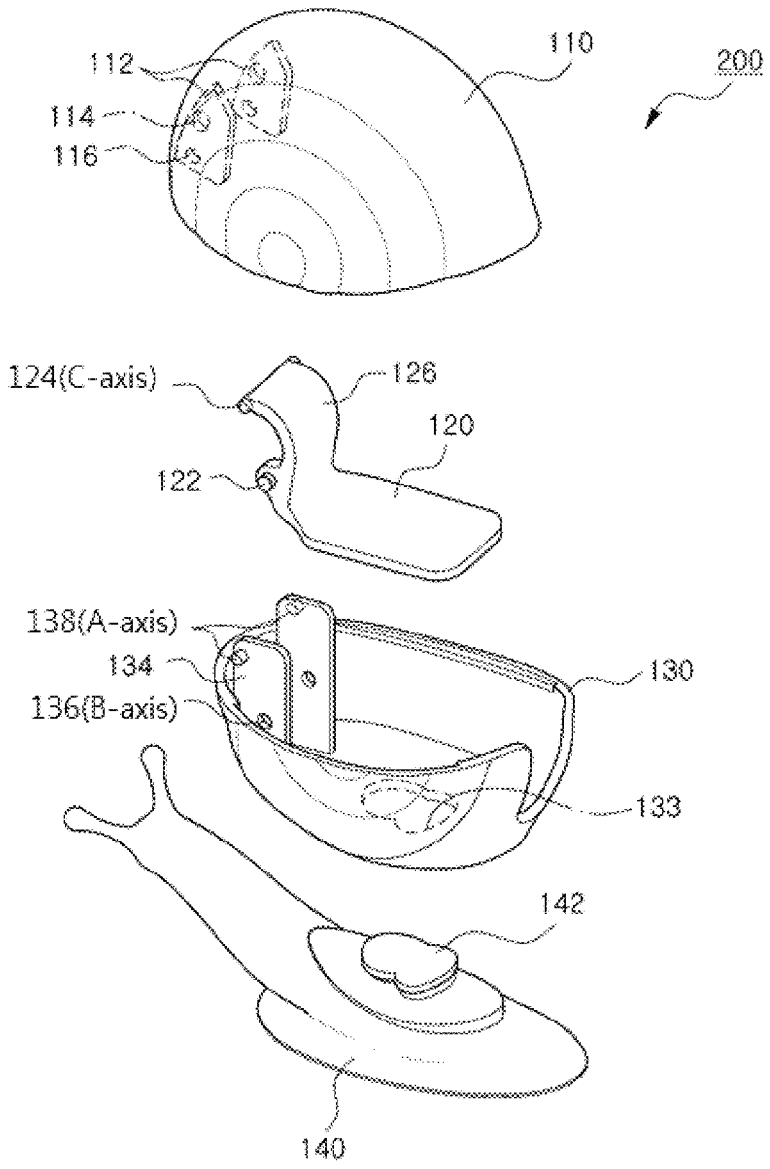
FIG. 6 is an exploded perspective view of a storage container according to another embodiment of the present invention.
Figure 7:
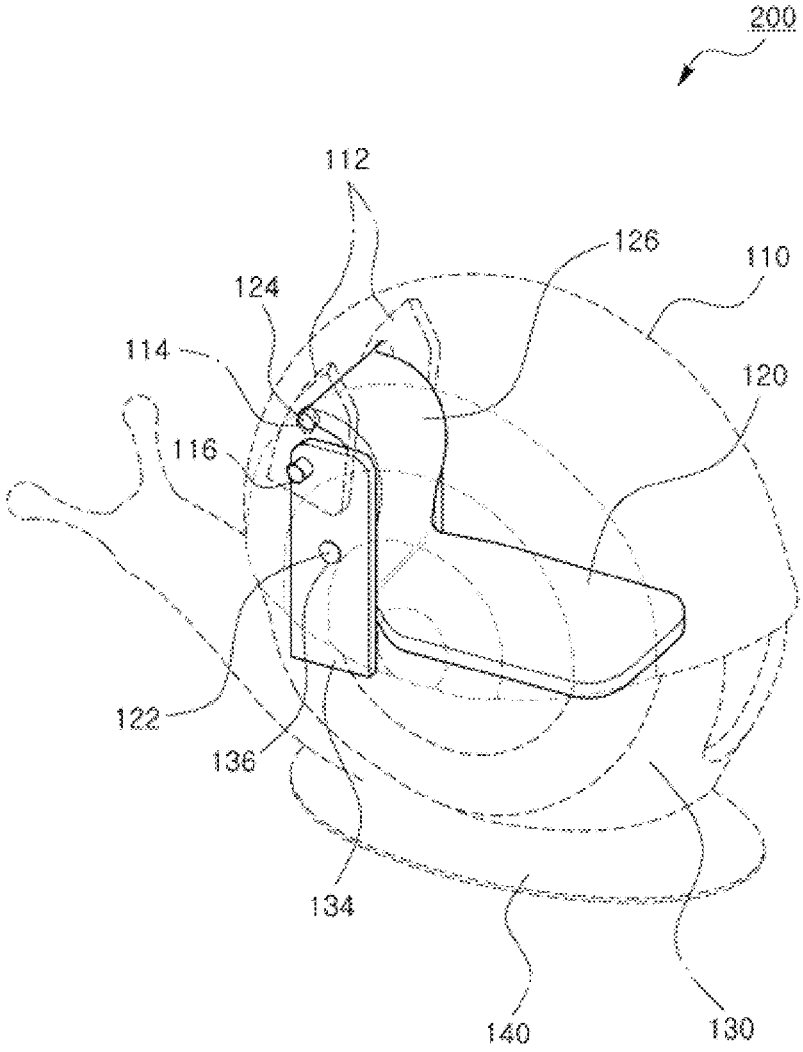
FIG. 7 is a perspective view illustrating an assembled state of the storage container of FIG. 6.
Figure 8:
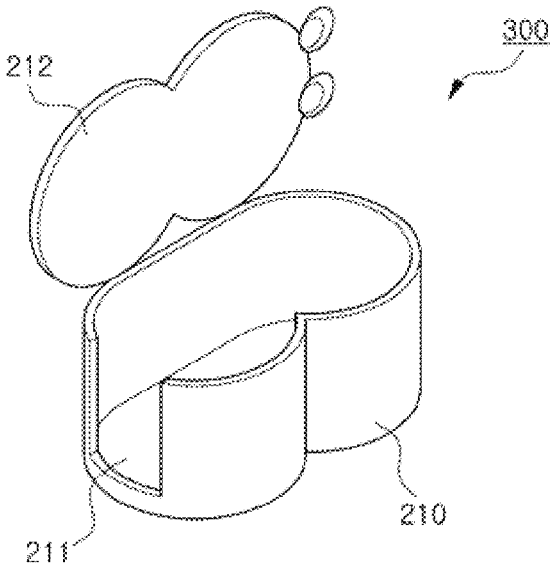
FIG. 8 is a perspective view of a conventional toothbrush holder.

FIG. 1 is a perspective view of a storage container according to an embodiment of the present invention. FIG. 2 is an exploded perspective view of the storage container of FIG. 1. FIG. 3 is a perspective view illustrating an internal space of a cover part of the storage container of FIG. 1. FIG. 4A to FIG. 4C illustrate operation of a connection part in the storage container of FIG. 1. FIG. 5A to FIG. 5C are views illustrating the use of the storage container of FIG. 1. FIG. 6 is an exploded perspective view of a storage container according to another embodiment of the present invention. FIG. 7 is a perspective view illustrating an assembled state of the storage container of FIG. 6.

Referring first to FIG. 1 and FIG. 2, the storage container 100 includes a cover part 10 with which a cover brackets 12 having a coupling hole 14 and a rotary hole 16 is integrated, a body part 30 disposed below the cover part 10 and with which a body bracket 34 having an engaging protrusion 36 and a rotary protrusion 38 is integrated, and a connection part C having an coupling protrusion 24 and an engaging hole 22 so as to connect the cover part 10 and the body part 30 to each other.

In the meantime, although it is described that the coupling hole 14 and the rotary hole 16 are provided in the cover brackets 12 of the cover part 10, and the engaging protrusion 36 and the rotary protrusion 38 are provided on the body bracket 34 of the body part 30, the cover brackets 12 and the body bracket 34 may be omitted. In this case, the coupling hole 14 and the rotary hole 16 may be provided directly in the cover part 10, and the engaging protrusion 36 and the rotary protrusion 38 may be provided directly on the body part 30.

The cover part 10 is a cover member that can be opened and closed with respect to the body part 30 when an article is put in and out of a storage space. The cover part 10 has an internal space for storing an article.

Referring to FIG. 2 and FIG. 3, the inside of the cover part 10 is integrally provided, on one side thereof, with a pair of cover brackets 12, and integrally provided, on the other side thereof, with a support 19.

The pair of cover brackets 12 in the cover part 10 are fixedly disposed one by one on one side in the cover part 10. The cover brackets 12 each have the coupling hole 14 and the rotary hole 16 vertically spaced at a predetermined distance.

The coupling hole 14 is an element into which the coupling protrusion 24 provided on an elastic member 26 of the connection part C is inserted and which has a substantially vertically elongated oval shape in cross section.

Such an oval shape of the coupling hole 14 serves to reduce a force of the coupling protrusion 24 applied to the coupling hole 14 within a predetermined range during opening of the cover part 10.

That is, if the coupling hole 14 has the same circular cross-sectional shape as the coupling protrusion 24, when a user applies an excessive force in order to open the cover part 10, the coupling protrusion 24 may be broken. Therefore, the coupling hole 14 has the vertically elongated oval sectional shape in order to provide a motion tolerance to allow the coupling protrusion 24 to move even when an excessive force is applied. Of course, the coupling hole 14 may have a circular cross-sectional shape like the coupling protrusion 24.

In the meantime, first and second auxiliary holes 17 and 18 are further provided in proximity to the rotary hole 16 so as to communicate with the rotary hole 16. The first and second auxiliary holes 17 and 18 are elements through which an auxiliary protrusion 39 of the body part 30 to be described is inserted or released.

That is, the first and second auxiliary holes 17 and 18 are provided perpendicular to each other with respect to the rotary hole 16 such that the auxiliary protrusion 39 is inserted into the first auxiliary hole 17 during opening of the cover part 10 and the auxiliary protrusion 39 is inserted into the second auxiliary hole 18 during closing of the cover part 10.

The auxiliary protrusion 39, the first auxiliary hole 17, and the second auxiliary hole 18 ensure stable opening and closing of the cover part 10 with respect to the body part 30.

The support 19 is integrally provided on one side in the cover part 10 so as to have a planar surface of a certain area, thereby enlarging a contact area for an article such as a toothbrush when a user opens the cover part 10. Thus, the support serves to facilitate easy opening of the cover part 10 without a user's excessive force being applied. Thereby, the provision of the support 19 allows a user to easily open the cover part 10 without using his/her hands, but only using one end of an article.

However, among the above-mentioned configurations, the auxiliary protrusion 39, the first auxiliary hole 17, the second auxiliary hole 18, and the support 19 may be omitted according to another embodiment of the present invention.

The body part 30 is an element that forms a frame to support an article to be stored. The body part 30 is integrally provided therein with the body bracket 34. The body bracket 34 has the rotary protrusion 38 to be inserted into the rotary hole 16 of the cover part 10, the auxiliary protrusion 39 provided in proximity to the rotary protrusion 38, and the engaging protrusion 36 to be inserted into the engaging hole 22 of the connection part C.

Further, the body part 30 has an insertion hole 33 through which an insertion protrusion 42 of an attachment part 40 is fixedly inserted to attach the storage container 100 onto an installation surface.

Here, the installation surface means a wall surface or the like onto which the storage container 100 is attached, and the attachment part 40 may comprise a conventional press-fitting member or the like.

Further, the body part 30 has a insertion slit 32 through which one front end of an article such as a toothbrush passes when the article is received in a space defined by the cover part 10 and the body part 30.

The connection part C serves to connect the cover part 10 and the body part 30 such that the connection part provides an elastic force in an opening direction and a closing direction of the cover part 10 during opening and closing of the cover part 10, respectively.

In this regard, the connection part C includes a rotary member 20 having a planar surface of a certain area, and pair of elastic members. 26 bent from one end of the rotary member 20.

The rotary member 20 is a planar element that is rotated at an angle within a predetermined value during opening or closing of the cover part 10 with respect to the body part 30, i.e. during relative movement of the cover part 10 to the body part 30. The elastic members 26 are bar-type elements that are bent from one end of the rotary member 20 so as to provide an elastic force during relative movement of the cover part 10 to the body part 30.

In the present embodiment, as shown in FIG. 2, the elastic members 26 consist of a pair of bar-type members spaced apart a predetermined distance from each other.

Since the rotary member 20 and the elastic members 26 are integrally formed, the elastic members 26 are rotated along with the rotation of the rotary member 20.

In the meantime, the elastic members 26 have the engaging holes 22 through which the engaging protrusions 36 of the body part 30 are inserted and coupled, whereby the connection part C can be wholly rotated (pivoted) about a central axis (B-axis in FIG. 2).

In addition, the connection part has the coupling protrusions 24 that are inserted into the coupling holes 14 of the cover part 10 so as to, during opening of the cover part 10, allow the elastic members 26 to provide an elastic force in the opening direction of the cover part 10.

The operative principle of the connection part C will now be described in detail with reference to FIG. 4A to FIG. 4C. FIG. 4A shows the case in which an opening angle of the cover part 10 is 0 degree (the angle and the following angles are defined from a horizontal plane) and a rotating angle of the rotary member 20 is 0 degree, FIG. 4B shows the case in which an opening angle of the cover part 10 is 40 degrees and a rotating angle of the rotary member 20 is 14 degrees, and FIG. 4C shows the case in which an opening angle of the cover part 10 is 80 degrees and a rotating angle of the rotary member 20 is 31 degrees.

First, when the cover part 10 is opened while being moved relative to the body part 30, the engaging protrusions 36 of the body part 30 are inserted and coupled into the engaging holes 22 of the rotary member 20 (B-axis), and the coupling protrusions 24 of the rotary member 20 are inserted and coupled into the coupling holes 14 of the cover part 10 (C-axis), so that during opening of the cover part 10, the elastic members 26 are further opened from a middle opening angle (about 40 degrees) to start providing an elastic force so that the cover part 10 is forced in the opening direction at or above a predetermined angle (40 degrees) due to the elastic force and thus comes to a fixed opened state.

Further, when the cover part 10 is closed while being rotated relative to the body part 30, the rotary protrusions 38 of the body part 30 are inserted and coupled into the rotary holes 16 of the cover part 10 (A-axis), so that the elastic members 26 of the rotary member 20 are further opened from the middle opening angle (about 40 degrees) to start providing an elastic force so that the cover part 10 is forced in the closing direction at or below a predetermined angle (40 degrees) due to the elastic force and thus comes to a fixed closed state.

That is, with the configuration of the elastic members 26 bent from the rotary member 20 and relation of the coupling (B-axis) between engaging holes 22 of the rotary member 20 and the engaging protrusions 36 of the body part 30, the coupling (C-axis) between the coupling protrusions 24 of the rotary member 20 and the coupling holes 14 of the cover part 10, and the coupling (A-axis) between the rotary protrusions 38 of the body part 30 and the rotary holes 16 of the cover part 10, the elastic members 26 provides an elastic force to the cover part 10 during opening or closing of the cover part 10, thereby facilitating easy opening or closing of the cover part 10 without a user's excessive force being applied.

According to such a function of the connection part C, a user can easily open and close the cover part 10 through simple opening or closing of the cover part 10 without using his/her hands, but only using one end of an article such as a toothbrush.

In the meantime, in other embodiments, as shown in FIG. 6 and FIG. 7, the elastic member 26 may be formed with a solid type planar member bent from the rotary member 20, instead of a pair of bar-type members.

Contents of the respective configurations and operative principles of the embodiments of FIG. 6 and FIG. 7 are substantially the same as in the former embodiments, so a repeated description thereof will be omitted.

The storage container 100 of the present invention includes the connection part C providing an elastic force during opening or closing operation of the cover part 10, thereby providing an effect of easy receipt of a variety of articles such as a toothbrush or the like.

Although the present invention has been described with reference to the exemplary embodiments, the present invention is not limited to those disclosed in the description. Rather, those skilled in the art will appreciate that various modifications, additions and substitutions are made possible, without departing from the scope and spirit of the invention as disclosed in the accompanying claims. Therefore, it should be construed that the modifications, additions and substitutions fall within the technical scope and aspects of the present invention as defined by following claims and their equivalences.

INDUSTRIAL APPLICABILITY

The present invention is usable for storing a variety of articles.

The invention claimed is:

1. A storage container comprising:

a cover part;

a body part disposed below the cover part so as to form a storage space together with the cover part for storing an end of an article therein; and a connection part connecting the cover part and the body part to each other and configured to impart an elastic force in an opening direction or a closing direction of the cover part during opening or closing of the cover part with respect to the body part, wherein the connection part includes:

a rotary member configured to rotate at an angle within a predetermined value during relative movement of the cover part with respect to the body part; and at least one elastic member bent from one end of the rotary member so as to provide an elastic force during the relative movement of the cover part with respect to the body part.

2. The storage container according to claim 1, wherein the connection part comprises a pair of coupling holes formed at the at least one elastic member, and the body part comprises a pair of coupling protrusions respectively inserted into the pair of coupling holes such that during rotating motion of the rotary member, the connection part pivots about the body part.

3. The storage container according to claim 2, wherein the connection part comprises a pair of engaging protrusions disposed above the coupling holes formed at the at least one elastic member, and the cover part comprises a pair of engaging holes into which the pair of engaging protrusions are respectively inserted such that during opening of the cover part with respect to the body part, the connection part provides an elastic force in the opening direction of the cover part.

4. The storage container according to claim 2, wherein the body part comprises a pair of rotary protrusions and the cover part comprises a pair of rotary holes into which the pair of rotary protrusions are respectively inserted such that during closing of the cover part with respect to the body part, the connection part provides an elastic force in the closing direction of the cover part.

5. The storage container according to claim 3, wherein the body part further comprises a pair of auxiliary protrusions respectively disposed in proximity to the rotary protrusions and the cover part further comprises first and second auxiliary holes respectively formed substantially perpendicular to each other so as to communicate with the rotary holes such that in an opened state of the cover part, one of the auxiliary protrusions is inserted into the first auxiliary hole, and in a closed state of the cover part, the other auxiliary protrusion is inserted into the second auxiliary hole.

6. The storage container according to claim 3, wherein the coupling protrusion comprises a circular cross-sectional shape and the coupling hole comprises a vertically elongated cylindrical cross-sectional shape such that during opening of the cover part, an interactive force between the coupling protrusion and the coupling holes is reduced within a predetermined range.

* * * * *